United States Patent [19]

Taylor

[11] Patent Number: 4,905,339

[45] Date of Patent: Mar. 6, 1990

[54] MOPPING UNIT

[75] Inventor: Michael Taylor, Lower Norton, Great Britain

[73] Assignee: Scot Young Service Systems Limited, West Midlands, England

[21] Appl. No.: 362,614

[22] Filed: Jun. 7, 1989

[30] Foreign Application Priority Data

Jun. 18, 1988 [GB] United Kingdom ..... 8814549

[51] Int. Cl.[4] ..... A47L 13/58

[52] U.S. Cl. ..... 15/262

[58] Field of Search ..... 15/260, 262

[56] References Cited

U.S. PATENT DOCUMENTS

| | | | |
|---|---|---|---|
| 582,975 | 5/1897 | Best | 15/262 |
| 1,583,550 | 5/1926 | Hartman | 15/262 |
| 1,905,556 | 4/1933 | Fathauer | 15/262 |
| 2,229,510 | 1/1941 | Lawlor | 15/262 |

FOREIGN PATENT DOCUMENTS

| | | | |
|---|---|---|---|
| 517373 | 2/1953 | Belgium | 15/262 |
| 269701 | 10/1950 | Switzerland | 15/262 |

*Primary Examiner*—Chris K. Moore

*Attorney, Agent, or Firm*—Collard, Roe & Galgano

[57] ABSTRACT

A mopping unit comprises a mop bucket combined with a wringer having two squeeze rollers mounted at the top of the bucket. An operating mechanism for the squeeze rollers includes a toggle linkage comprising two toggle links which are directly interconnected at a toggle pivot. When the two toggle links are aligned, the toggle pivot is substantially coplanar with the separate rotational axes of the two squeeze rollers one of which is moved, to the operative wringing position, by the operating mechanism on depression of a foot pedal.

16 Claims, 2 Drawing Sheets

MOPPING UNIT

BACKGROUND OF THE INVENTION

1. Field of the Invention

The invention relates to so-called "mopping units" as used with wet mopping systems. Such a unit comprises a mop bucket combined with a wringer having two squeeze rollers between which a mop can be wrung out into the bucket.

2. Description of the Prior Art

Mopping units are in general use for the wet and damp mopping of surfaces, particularly internal floor and wall surfaces of buildings such as offices and hospitals. In Patent No. 4,716,619 there is disclosed a foot-operated mopping unit requiring the use of only one foot with a squeeze pressure, applied to a mop whilst being wrung out, independent of foot pressure. According to that patent disclosure, the operating mechanism for the squeeze rollers mounted at the top of the bucket comprises a toggle operating linkage which, on depression of a foot pedal at a lower level, produces relative closing movement of the squeeze rollers. The operating linkage comprises two pivotally interconnected toggle links which go slightly overcentre to maintain the rollers at a predetermined spacing in the wringing position, and this arrangement has enjoyed marked commercial success.

SUMMARY OF THE INVENTION

The present invention has for its object the development of the toggle mechanism of the foregoing arrangement to provide operational and manufacturing advantages. To this end, according to one aspect of the invention, the operating mechanism includes a toggle linkage comprising two toggle links which are directly interconnected at a pivot which, when the two toggle links are aligned, is substantially coplanar with the separate rotational axes of the two squeeze rollers one of which is moved, to the operative wringing position, by the mechanism on depression of a foot pedal.

Preferably the two toggle links are aligned on opposite sides of said pivot axis so that they act as a direct strut to support the movable roller in the wringing position. This enables the mechanism to create high wringing pressures at the rollers, whilst the toggle links can maintain the maximum roller pressure without any flexing in the mechanism as a whole. Whilst in the ideal condition the toggle links would be precisely aligned in the wringing position, it will be appreciated that to accommodate manufacturing tolerances and general wear it will for practical reasons normally be arranged that the toggle linkage goes very slightly overcentre to a limit position defined by a suitable stop. This also enables the linkage to be self-maintaining in the wringing position independently of applied foot pressure so long as the wringing reaction pressure is applied to the movable roller.

Preferably the foot pedal is integral with a lever which is directly connected to one of the toggle links through a plain pivotal link, and a return spring may act on the toggle linkage tending to return it to the normal resting position with maximum roller spacing. The return spring force is desirably such that it is not sufficient to "break" the toggle, when the latter is in the substantially aligned operative condition, whilst the squeeze pressure reaction is applied to the movable roller.

According to another aspect of the invention, the operating mechanism has a toggle linkage duplicated at opposite sides of the bucket and comprising, at each side, two pivotally interconnected toggle links which in the operative condition of the mechanism are substantially aligned to provide a toggle strut acting directly on the movable roller to retain the latter in the wringing position.

Other features of the invention will be apparent from the following description, drawings and claims, the scope of the invention not being limited to the drawings themselves as the drawings are presented solely for the purpose of illustrating a way in which the principles of the invention can be applied. Other embodiments of the invention which utilize the same or equivalent principles may be used and structural changes may be made as desired by those skilled in the art without departing from the present invention and the purview of the appended claims.

DESCRIPTION OF THE PREFERRED EMBODIMENT

Figure 1:
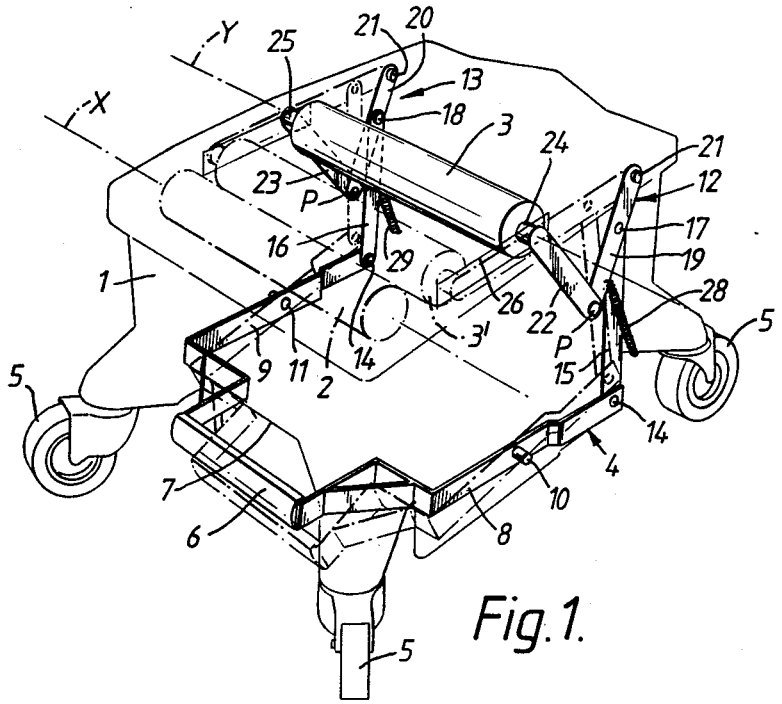
FIG. 1 is a schematic perspective view of a preferred embodiment, drawn to illustrate novel operating mechanism of the invention.
Figure 2:
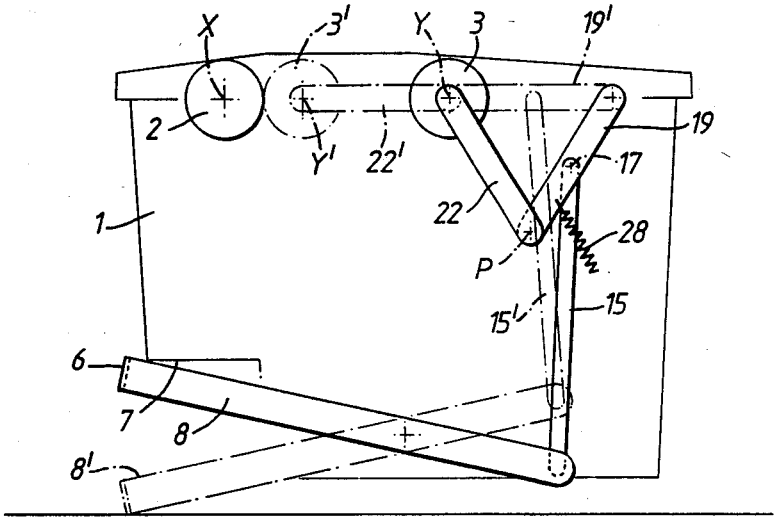
FIG. 2 is a side view illustrating the kinematics of the mechanism.

The mopping unit illustrated comprises a moulded plastics bucket 1, shown mainly in ghost outline in FIGS. 1 and 2 so that the operating mechanism is clearly visible, combined with a wringer having two rotatable squeeze rollers 2 and 3 with rotational axes X and Y disposed laterally of, and housed within, the bucket 1. The roller 2 has the position of its axis X fixed adjacent the front of the bucket 1, this axis being adjustable as is later described, and the rear roller 3 is movable by an operating mechanism 4 between a free "open" wringer position shown in full lines in the drawing figures and a "closed" operative wringer position 3' illustrated in broken lines.

Four corner castors 5 support the bucket 1 raised off the floor. These castors are a push-in fit in moulded sockets such as **5*a*** and may be directly replaced, for use on smooth floors, by stand-off "glider" legs or by other floor support members.

Figure 3:
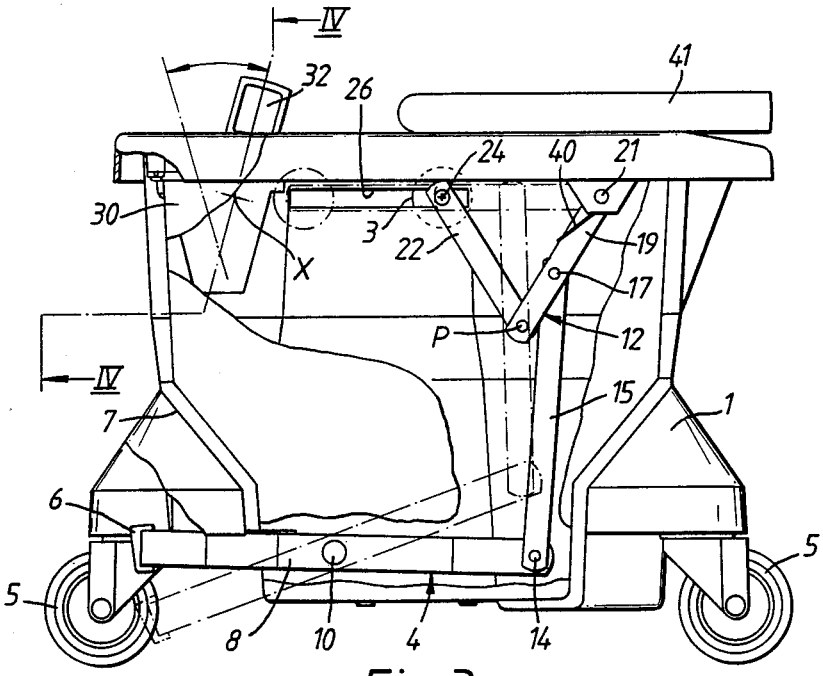
FIG. 3 is a side view, with an outer wall partly cut away to show normally hidden detail.
Figure 4:
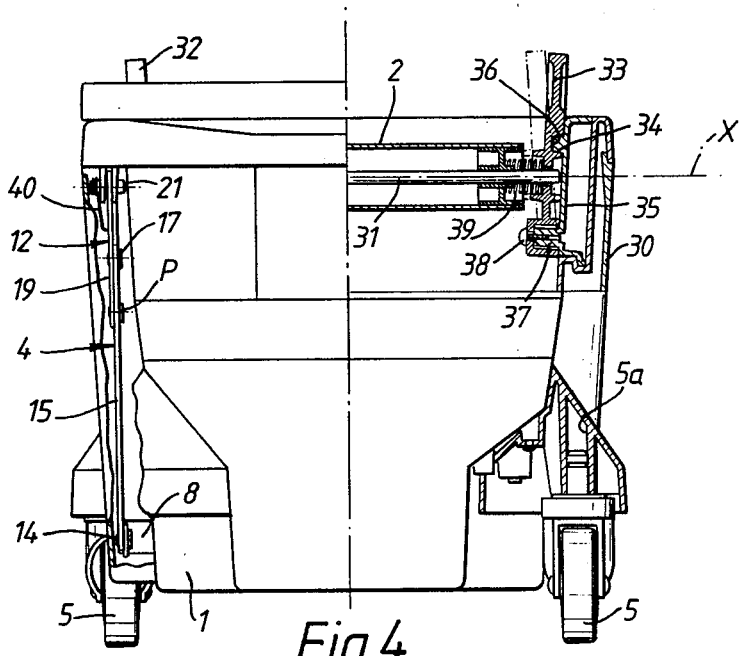
FIG. 4 is a rear view, similarly partly cut away on the right-hand side and the left-hand half of which is shown in section on the line IV—IV in FIG. 3.

A foot-operated pedal 6 of the mechanism 4 is disposed below the roller 2 in a central recess 7 at the front of the bucket 1, a shrouding outer side wall 30 of the bucket being partially cut away in FIG. 3 to show the recess 7 and the mechanism 4. The pedal 6 is connected at its two ends between respective pedal levers 8 and 9 which extend along the two sides of the bucket 1, to which they are pivotally mounted at intermediate pivots 10 and 11. The pivots 10 and 11 are horizontally aligned laterally of the bucket 1. The operating mechanism 4, on depression of the foot pedal 6, moves the rear roller 3 to the operative position 3' and applies a balanced squeeze pressure through the two ends of that roller, to this end the mechanism 4 employing toggle linkages 12 and 13 duplicated at opposite sides of the bucket 1.

At the rear ends the pedal levers 8 and 9 are connected at pivots 14, respectively, to the lower ends of two generally upright plain pivotal links 15 and 16. The upper ends of the links 15 and 16 are connected, by pivots 17 and 18 respectively, to intermediate positions of rear toggle links 19 and 20 of the respective toggle linkages 12 and 13. The toggle links 19 and 20 are mounted at outer ends by fixed aligned pivots 21 and respectively connected at the inner ends, at aligned pivots P, to front toggle links 22 and 23 of the toggle linkages 12 and 13. Opposed pivot mountings 24 and 25 respectively fixed to the toggle links 22 and 23 adjacent the outer ends of these links, at the inner sides thereof, pivotally support the respective ends of the movable roller 3. The roller pivot mountings 24 and 25 are respectively movable along horizontal guide slots such as 26 provided at a top edge region of the bucket 1, to guide the axis Y of the movable roller 3 as it moves between the open position 3 and the operative position 3'.

Reference has already been made to adjustability of the front roller 2 whereby to adjust the spacing of the rollers 2 and 3 when in the relatively closed operative position or, looked at another way, to adjust the squeeze pressure on a given mop. To this end a spindle 31 of the roller 2 is mounted so as to be freely rotatable between two adjustment levers 32 and 33 which have a range of angular adjusting movement as indicated in FIG. 3. A series of detent projections such as 34 is moulded on the internal surface of an inner side wall 35 of the bucket 1, at each side of the latter, and these projections are selectively engageable in a moulded recess 36 in the corresponding lever 32 or 33 to retain the latter in an adjusted angular position, which determines the position of the roller axis X, relatively to a moulded pivot boss 37 on which the lever is mounted. Each lever 32 or 33 is retained captive on the corresponding boss 37 by a screw 38 and can rock on that boss 37, against a compression spring 39 disposed between it and the adjacent end of the roller 2, to a position in which it clears the projections 34 to allow adjusting movement of the lever.

Thus adjustment of the roller axis X over a shallow arc is provided, this arc being generally aligned with the horizontal slots 26 in side view. Accordingly, in all adjusted positions of the front roller 2 each toggle pivot P, in the operative wringing position of mechanism 4, is substantially coplanar with the roller axes X and Y.

To wring out a mop it is inserted into the bucket 1 so as to hang down between the rollers 2 and 3 whilst the latter are in the open position. The foot pedal 6 is then depressed to extend the toggle linkages 12 and 13 and thus move the roller 3 to the closed position 3'. The toggle linkages 12 and 13 are then moved only just overcentre, which position is defined by engagement with a stop provided by the surface of a step in the bucket moulding, so that the links 19 and 22, and 20 and 23, are substantially aligned with the aligned mutual pivots P substantially coplanar with the separate roller axes X and Y. Thus the toggle linkages 12 and 13 effectively act as direct struts to maintain a predetermined spacing of the rollers 2 and 3 to apply the required squeeze pressure to the inserted mop (not shown) which is wrung out as it is pulled upwardly by hand between the rollers 2 and 3. It will be appreciated that foot pressure need be applied to the pedal 6 merely for the time and to the extent necessary to hold down the bucket against the upward pull applied to pull through the mop, the squeeze pressure being determined by the toggle linkages 12 and 13 and not being dependent on foot pressure.

At the end of the wringing operation, as the mop leaves the rollers 2 and 3 the toggle linkages are broken by the forces of return springs functionally illustrated in FIGS. 1 and 2 as tension springs 28 and 29 anchored to the bucket 1 and respectively connected to the toggle links 19 and 20. In the actual construction these springs are torsion springs such as 40 acting around the respective pivots 21 on the toggle links 19 and 20. The return spring force on each toggle linkage 12 or 13 is not sufficient to move the toggle links back overcentre, and thus to break the toggles, whilst the mop is applying a squeeze pressure reaction to the roller 3. As soon as the mop has left the wringer the springs 28 and 29 are able to return the operating mechanism to the rest position when the foot is removed from the pedal 6.

The bucket 1 has a bail-type handle 41 used for carrying purposes. When not in use it pivots rearwardly to lie on top of the bucket where it does not impede the wringing out operation when the wringer rollers 2 and 3 are in use.

It will be appreciated from the foregoing description that the invention provides a very simple, efficient and effective roller operating mechanism of a mopping unit. The direct toggle struts provided by the toggle linkages 12 and 13 provide accurate and repeatable roller positioning, and a high squeeze pressure can be applied without flexing of the elements of the operating mechanism affecting operation. A further and manufacturing advantage of the described construction is that the upright links 15 and 16 are the only elements of the operating mechanism which need be changed to suit a different size of bucket. Thus a range of bucket sizes can employ the same mechanism components other than the simple plain links 15 and 16.

What is claimed is:

1. A mopping unit comprising a mop bucket combined with a wringer, said wringer having two squeeze rollers mounted at the top of the bucket and including an operating mechanism for moving one of said rollers to an operative wringing position on depression of a foot pedal, said mechanism including a toggle linkage through which said one roller is moved and comprising two toggle links which are directly interconnected at a pivot which, when the two toggle links are aligned, is substantially coplanar with the separate rotational axes of the two squeeze rollers.

2. A mopping unit according to claim 1, wherein the two toggle links are aligned on opposite sides of said pivot axis so that they act as a direct strut to support the movable roller when in the wringing position.

3. A mopping unit according to claim 1, wherein the toggle linkage goes slightly overcentre to a limit position, defined by a stop, when in the wringing position.

4. A mopping unit according to claim 3, wherein a return spring which acts on the toggle linkage tends to return it to a normal resting position with maximum roller spacing and the return spring force is not sufficient to "break" the toggle, when the latter is in the substantially aligned operative condition, whilst the squeeze pressure reaction of a mop being wrung out is applied to the movable roller.

5. A mopping unit according to claim 1, wherein the foot pedal is integral with a lever which is directly connected to one of said toggle links through a plain pivotal link.

6. A mopping unit according to claim 1, wherein a return spring which acts on the toggle linkage tends to return it to a normal resting position with maximum roller spacing.

7. A mopping unit according to claim 1, wherein the other roller is adjustable so that the predetermined spacing of the rollers when in the wringing position, determined by the toggle linkage, can be varied to adjust the actual squeeze pressure applied to a mop.

8. A mopping unit according to claim 1, wherein the toggle operating mechanism is duplicated at the two sides of the bucket, whereby balanced operating forces are applied to the two ends of the movable roller.

9. A mopping unit according to claim 8, wherein one toggle link of each side toggle linkage is directly and pivotally connected to the corresponding end of the movable roller.

10. A mopping unit according to claim 9, wherein pivot mountings for the movable roller attached to the connected toggle links are slidably guided in guide slots along the top edge region of the bucket.

11. A mopping unit according to claim 10, wherein said guide slots are horizontally disposed.

12. A mopping unit comprising a mop bucket combined with a wringer, said wringer having two squeeze rollers mounted at the top of the bucket and wherein an operating mechanism operative to move one of the rollers to a mop-wringing position has a toggle linkage duplicated at opposite sides of the bucket and comprising, at each side, two pivotally interconnected toggle links which in the operative condition of the mechanism are substantially aligned to provide a toggle strut acting directly on the movable roller to retain the latter in the wringing position.

13. A mopping unit according to claim 12, wherein the other one of said squeeze rollers is adjustable so that the spacing of the rollers when in the wringing position, determined by the toggle linkage, can be varied to adjust the actual squeeze pressure applied to a mop, said other adjustable roller being rotatably supported between two pivotal adjustment levers which are respectively pivotally supported on the sides of the bucket and which project at the top of the bucket for manual adjustment of the angular position of the levers.

14. A mopping unit according to claim 13, wherein pivot mountings for the movable roller attached to the connected toggle links are slidably guided in guide slots along the top edge region of the bucket, and the rotational axis of the adjustable roller is adjustable over a shallow arc generally aligned with said guide slots in side view.

15. A mopping unit according to claim 13, wherein detent means to retain each adjustment lever in adjusted angular position comprise inter-engageable formations on that lever and the corresponding side of the bucket.

16. A mopping unit according to claim 15, wherein the adjustment levers are mounted within the bucket and are rockable inwardly, against springs disposed between the ends of the adjustable roller and the levers, on the lever pivot mountings sufficiently to free the detent formations and allow angular adjustment movement of the levers.

* * * * *